US005551995A

United States Patent [19]

Nagayoshi

[11] Patent Number: 5,551,995

[45] Date of Patent: Sep. 3, 1996

[54] SPHEROIDAL GRAPHITE CAST IRON FOR CRANK SHAFTS AND A CRANK SHAFT MANUFACTURED FROM SUCH CAST IRON

[75] Inventor: Hideaki Nagayoshi, Kitakyushu, Japan

[73] Assignee: Hitachi Metals, Ltd., Tokyo, Japan

[21] Appl. No.: 397,925

[22] Filed: Mar. 3, 1995

[30] Foreign Application Priority Data

Mar. 11, 1994 [JP] Japan ..... 6-040821

[51] Int. Cl.[6] ..... C22C 37/04

[52] U.S. Cl. ..... 148/321; 148/904; 420/13

[58] Field of Search ..... 420/13; 148/321, 148/904

[56] References Cited

U.S. PATENT DOCUMENTS 4,363,661 12/1982 Kovacs .

4,767,278 8/1988 Enderlein, Jr. .

FOREIGN PATENT DOCUMENTS 64-62439 3/1989 Japan .

*Primary Examiner*—Deborah Yee

*Attorney, Agent, or Firm*—Sughrue, Mion, Zinn, Macpeak & Seas

[57] ABSTRACT

Spheroidal graphite cast iron for crank shafts having a tensile strength of 75 kgf/mm$^2$ or more, and having excellent conformability and machinability, which cast iron consisting, by area ratio, of graphite of 5 to 15%, ferrite of not more than 10%, and the balance pearlite matrix, said cast iron having a Brinell hardness (HB) of 241 to 277.

6 Claims, 4 Drawing Sheets

SPHEROIDAL GRAPHITE CAST IRON FOR CRANK SHAFTS AND A CRANK SHAFT MANUFACTURED FROM SUCH CAST IRON

BACKGROUND OF THE INVENTION

The present invention relates to spheroidal graphite cast iron that excels in conformability and machinability, and more particularly, to spheroidal graphite cast iron suited for the use in high-speed rotary members, and especially in vehicle engines.

In order to enhance the mechanical strength of spheroidal graphite cast iron, there has been developed technique for forming a pearlite structure by adding pearlite-making elements such as Cu, Mn, Sn, Sb and As. For example, JP-A-64-62439 publication discloses a technique for forming a spheroidal graphite cast iron having a matrix of a pearlite structure and graphite particles of not less than 250 pieces/mm$^2$, in which cast iron it is stated that a tensile strength in the level of about 70 kgf/mm$^2$ was obtained.

In recent years, as the decrease of cylinder block weight has been required, the design of higher Young's modulus has become necessary, and a spheroidal graphite cast iron having a tensile strength not less than 75 kgf/mm$^2$ has been demanded. In such a spheroidal graphite cast iron as has this high mechanical strength, a pearlite area rate increases, with the result that its hardness necessarily increases and its machinability decreases. Therefore, the development of a novel technique has been desired in the field of spheroidal cast iron.

SUMMARY OF THE INVENTION

It is an object of the present invention to provide spheroidal graphite cast iron for crank shafts which cast iron has a tensile strength not less than 75 kgf/mm$^2$ together with excellent conformability and machinability.

Spheroidal graphite cast iron for crank shafts of the present invention consists, by area ratio, of 5–15% graphite, not more than 10% ferrite, and the balance pearlite matrix, which cast iron has a Brinell hardness (HB) of 241–277, and excels in conformability and machinability. It is preferred that the chemical composition of the spheroidal graphite cast iron consists, by weight, of: 3–4% C; 1.5–2.5% Si; less than 0.5% Mn; 0.005–0.08% Mg; at least one of 0.010–0.050% in total amount selected from the group consisting of Sn, Sb and As; and the balance iron and incidental impurities. The machinability of the cast iron is very good in a case where the micro Vicker's hardness (HMV) of the pearlite matrix when measured at a load of 100 g is 250–350 and is small in variation. Further, the breakdown of ferrite rings by increasing the concentration of at least one element of Sn, Sb, and As in the interfaces between graphite and pearlite matrix is also very effective for improving machinability.

The reason for limiting the amount of each constituent will be explained below.

The amount of C was limited to the range in which graphite is stably generated in the cast iron. If the amount of C is less than 3%, drawability (, that is, the degree of shrinkage occurring during the solidification of molten metal when a cast product is produced) will become poor, and tendency to cause chill will increase. If the amount of C exceeds 4%, kish graphite will be readily caused, especially in articles having a thickness of 30 mm or more. Preferably, the amount of C is about 3.6 to about 3.8%.

The amount of Si was limited in view of brittleness. If the amount of Si exceeds 2.5%, impact resistance at low temperatures decreases significantly, and if the amount of Si is less than 1.5%, the drawability will increase and tendency to cause chill will increase. Preferably, the amount of Si is 2.0 to 2.2%.

Mn is an impurity affecting the properties of the cast iron of the invention. If the amount of Mn is not less than 0.5%, the proportion of cementite increases, and hardness of the pearlite matrix itself will become uneven and high. Preferably, the amount of Mn is not more than 0.4%.

If the amount of Mg is less than 0.005%, graphite flakes will be caused, and if the amount of Mg exceeds 0.08%, explosive graphite will be apt to occur and the mechanical strength decreases. Preferably, the amount of Mg is 0.01–0.05%.

If the total amount of at least one of Sn, Sb and As is less than 0.010%, the control of diffusion and adsorption of C will become difficult due to the shortage of Sn, Sb, and/or As distributed in the interfaces between graphite and matrix, and ferrite will increase, resulting in poor machinability. If this amount exceeds 0.030%, impact resistance will decrease due to the excessive amount of Sn, Sb and/or As distributed in the interfaces.

P, S, Cr and Cu are impurities causing significant influences on the properties of the cast iron of the present invention, and it is preferred to limit the amounts of P, S, Cr and Cu to ranges of not more than 0.3%, not more than 0.02%, not more than 0.5% and not more than 0.6%, respectively.

DETAILED DESCRIPTION OF THE PREFERRED EMBODIMENTS

Figure 1:
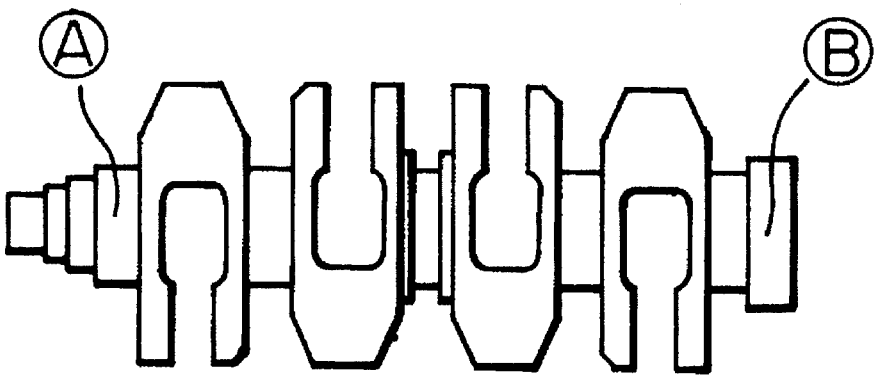
FIG. 1 shows a top view of a crank shaft.

The preferred embodiments of the present invention will be described below while referring to the drawings.

Crank shafts each weighing about 7 kg as shown in FIG. 1 were cast while using green sand molds. The chemical compositions and properties of tests pieces prepared from five crank shafts thus cast are shown in Tables 1 to 6.

TABLE 1

| Sample | Chemical composition (% by weight) | | | | | | | | | | |
|---|---|---|---|---|---|---|---|---|---|---|---|
| No. | C | Si | Mn | P | S | Mg | Cr | Cu | Sn | Sb | As |
| 1 | 3.64 | 2.10 | 0.36 | 0.019 | 0.013 | 0.038 | 0.03 | 0.56 | 0.021 | — | — |
| 2 | 3.68 | 2.11 | 0.35 | 0.019 | 0.014 | 0.036 | 0.03 | 0.55 | 0.010 | 0.012 | — |
| 3 | 3.68 | 2.08 | 0.36 | 0.018 | 0.014 | 0.038 | 0.03 | 0.55 | — | 0.021 | — |
| 4 | 3.70 | 2.08 | 0.36 | 0.021 | 0.015 | 0.040 | 0.03 | 0.57 | — | 0.012 | 0.007 |
| 5 | 3.71 | 2.11 | 0.36 | 0.019 | 0.014 | 0.040 | 0.03 | 0.56 | 0.010 | 0.012 | 0.008 |

Since elements such as Sn, Sb and As are almost distributed in the interface between graphite and matrix, the pearlite matrix substantially contains little of such elements, and the hardness of the matrix itself becomes uniform. Also, since ferrite existing around the graphite becomes small in amount, the contents of Cu and Mn can be reduced, so that machinability is improved.

TABLE 2

| Sample | Mechanical strength | | | | | |
|---|---|---|---|---|---|---|
| | Tensile strength ($kgf/mm^2$) | | Yield strength ($kgf/mm^2$) | | Elongation (%) | |
| No. | A* | B** | A | B | A | B |
| 1 | 80.0 | 79.2 | 45.1 | 46.6 | 10.2 | 10.2 |
| 2 | 79.7 | 79.9 | 45.2 | 46.3 | 8.9 | 9.3 |
| 3 | 79.5 | 80.2 | 46.0 | 46.3 | 9.4 | 9.6 |
| 4 | 79.8 | 80.4 | 46.2 | 46.5 | 9.7 | 10.1 |
| 5 | 80.4 | 79.7 | 46.4 | 46.7 | 9.9 | 9.7 |

*A: sampled from the left terminal end of each crank shaft
**B: sampled from the right terminal end of each crank shaft The tensile strength of each test piece was not less than 75 $kgf/mm^2$, and the yield strengths thereof was not less than 45 $kgf/mm^2$, that is, there was obtained stable spheroidal graphite cast iron.

TABLE 3

| | Brinell hardness (results of 30 test pieces regarding each of Nos. 1 to 5) | | | | |
|---|---|---|---|---|---|
| HB | No. 1 | No. 2 | No. 3 | No. 4 | No. 5 |
| 269 | | 1 | 2 | | 1 |
| 262 | 12 | 10 | 12 | 16 | 16 |
| 255 | 10 | 8 | 12 | 14 | 13 |
| 248 | 8 | 11 | 4 | | |
| Average | 255.9 | 255.2 | 257.8 | 258.7 | 259.2 |
| σn-1 | 5.74 | 5.93 | 5.70 | 3.55 | 3.94 |

Figure 2:
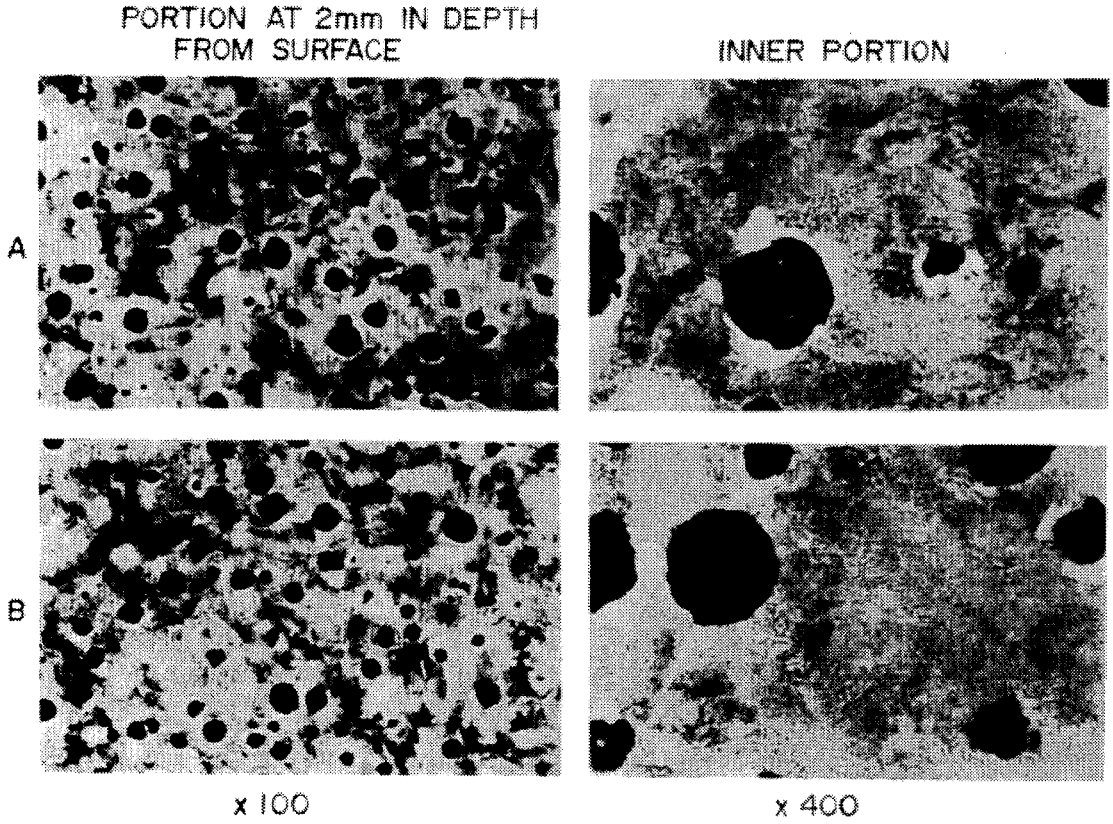
FIG. 2 shows photographs of the microstructure of Sample No. 1.
Figure 3:
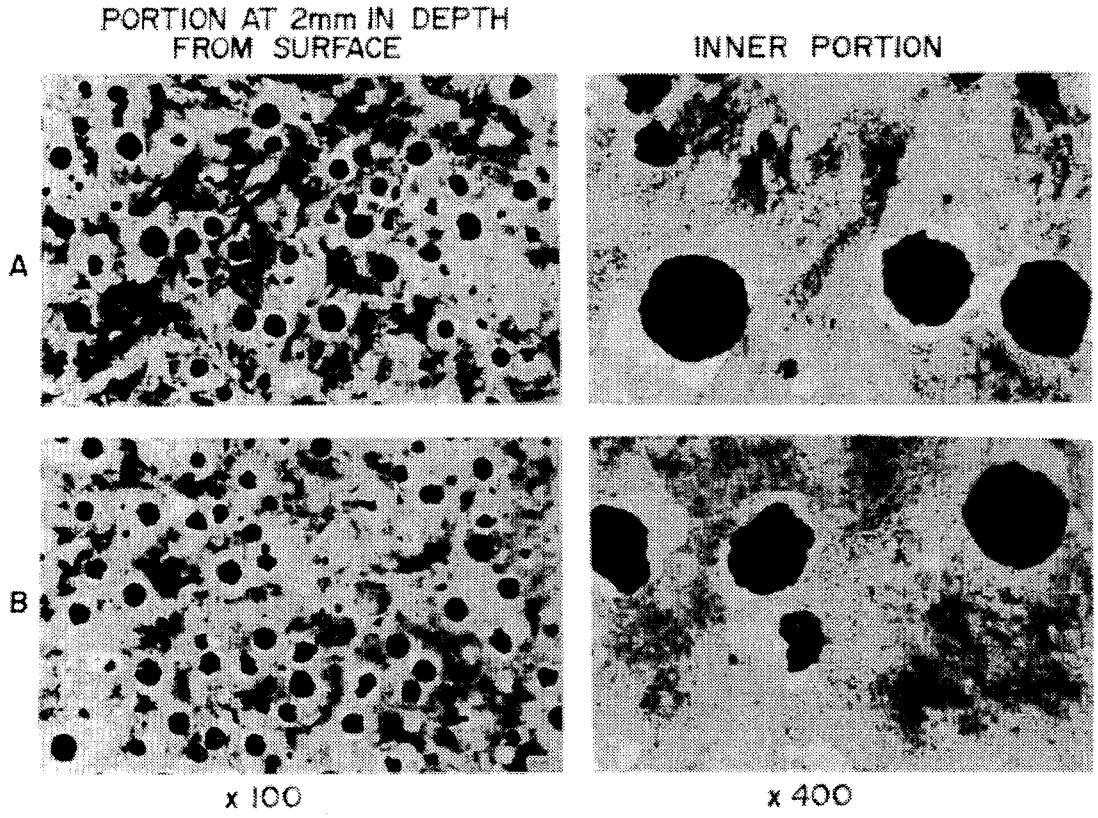
FIG. 3 shows photographs of the microstructure of Sample No. 2.
Figure 4:
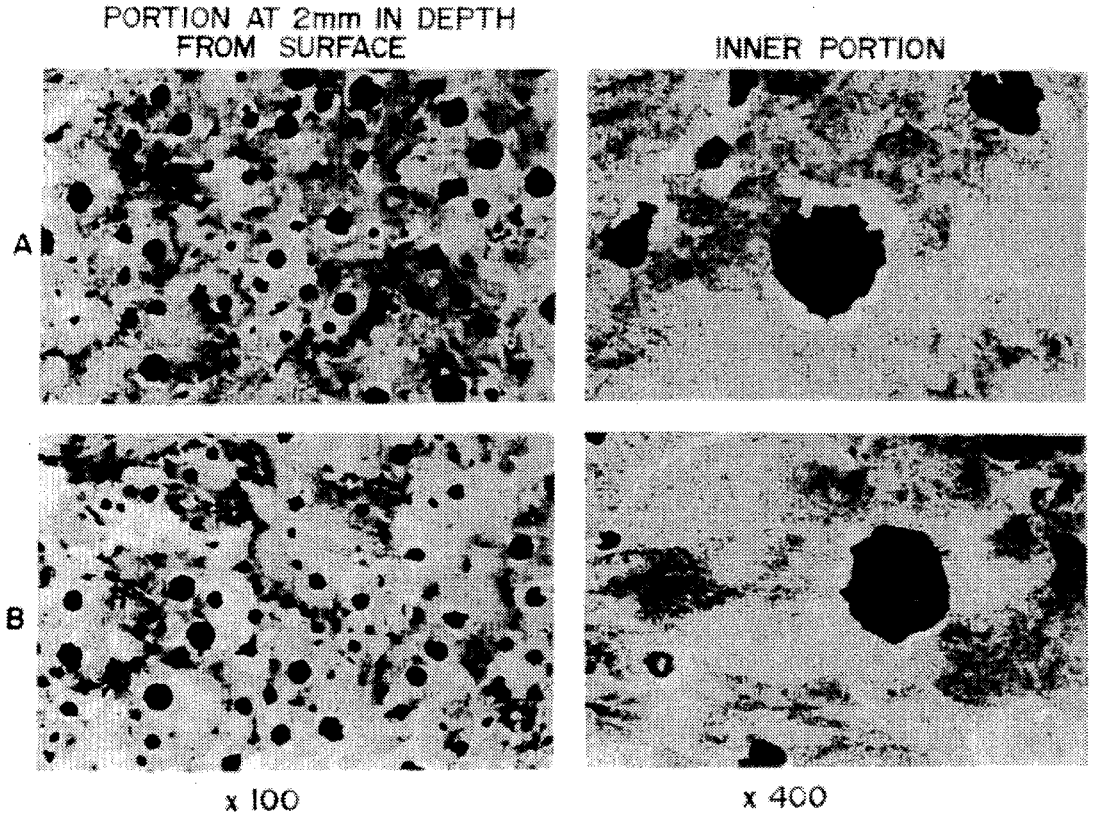
FIG. 4 shows photographs of the microstructure of Sample No. 3.
Figure 5:
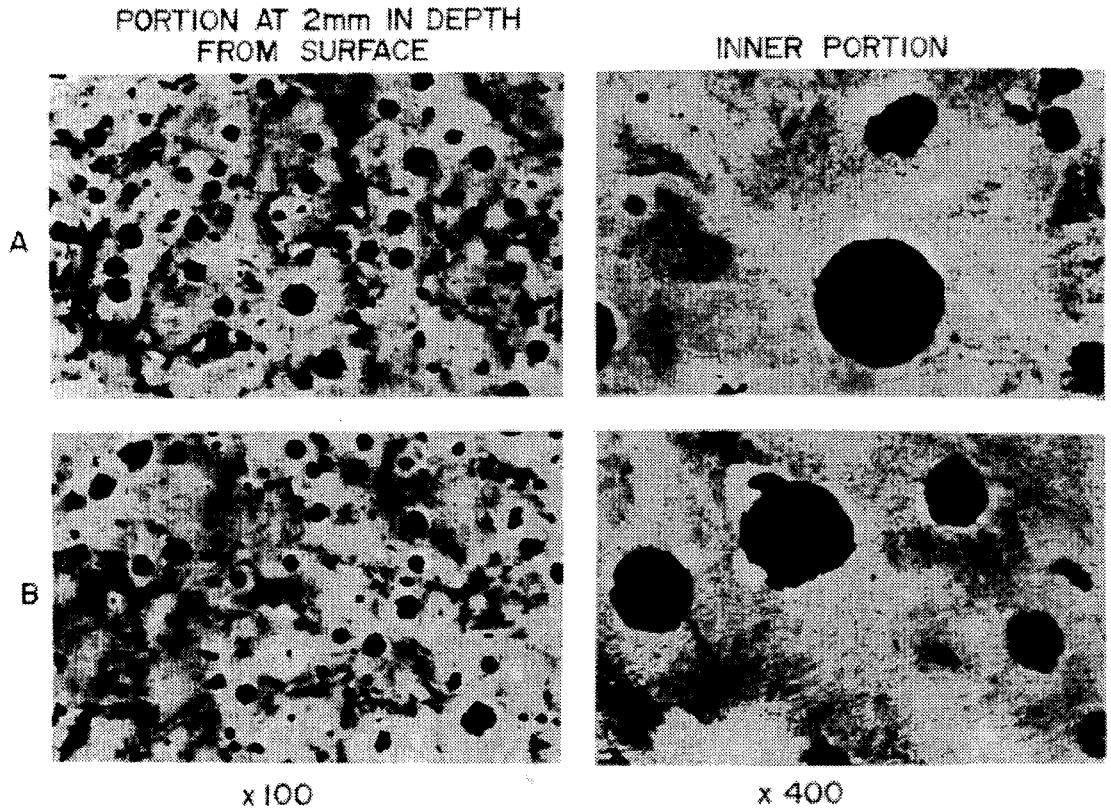
FIG. 5 shows photographs of the microstructure of Sample No. 4.
Figure 6:
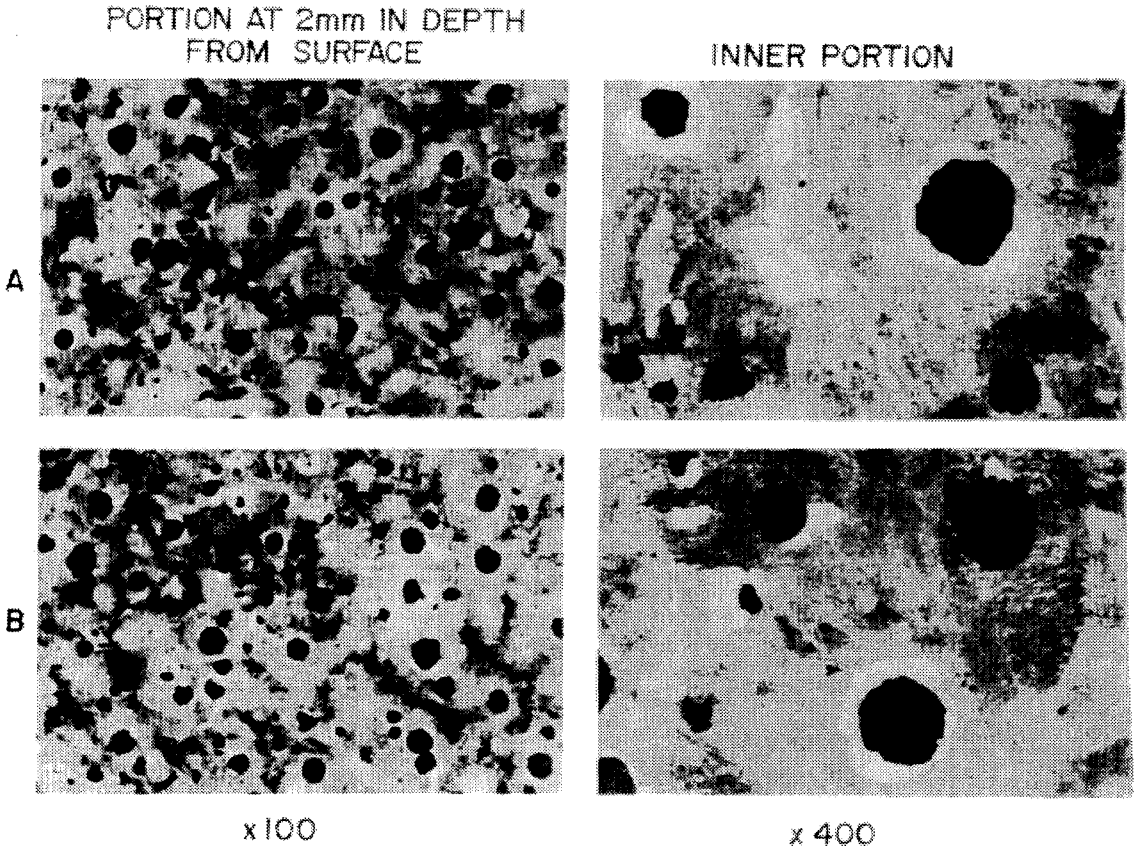
FIG. 6 shows photographs of the microstructure of Sample No. 5.

The microstructures of the test pieces with a Brinell hardness of 248 regarding samples Nos. 1–3 are shown in FIGS. 2–4, and the microstructures of the test pieces with a Brinell hardness of 255 regarding samples Nos. 4 and 5 are shown in FIGS. 5 and 6, respectively. Macro Brinell hardnesses were distributed around HB 255, indicating that the material was stable and was small in variation.

The ferrite rings are broken down by increasing the concentration of Sn, Sb and/or As in the interfaces between graphite and matrix, which increasing minimizes the diffusion and adsorption of graphite and C in matrix to make the C content around graphite be not less than 0.1% to thereby produce the condition under which ferrite is hardly formed. Thus, the present invention brings about a significant effect on the improvement of machinability.

TABLE 4

| Sample | Brinell hardness | | | | Micro Vicker's hardness | |
|---|---|---|---|---|---|---|
| | Surface | | Interior | | Pearlite matrix | |
| No. | A | B | A | B | A | B |
| 1 | 259 | 264 | 252 | 251 | 290 | 297 |
| 2 | 248 | 255 | 248 | 248 | 290 | 309 |
| 3 | 255 | 262 | 255 | 248 | 296 | 307 |
| 4 | 255 | 260 | 260 | 255 | 292 | 301 |
| 5 | 250 | 264 | 251 | 249 | 295 | 302 |

Brinell hardness: 10 mm dia./3000 kg
Micro Vicker's hardness: 100 g load

In a case where Cu and Mn are contained in a relatively high content in a cast iron as in the case of prior art, since the contents of these elements are high in the pearlite matrix, the micro Vicker's hardness becomes as high as 340–380 in Micro Vicker's Hardness. On the other hand, in the spheroidal graphite cast iron of the present invention the hardness thereof becomes about 300 in Micro Vicker's Hardness and becomes stable at a low hardness level, which is also a factor for bringing about the improvement of machinability.

TABLE 5

| Sample | Structure | | | |
|---|---|---|---|---|
| | Ferrite Occurrence Rate (%) | | | |
| | 2 mm below the surface | | Interior part | |
| No. | A | B | A | B |
| 1 | 9.2 | 9.9 | 7.2 | 9.1 |
| 2 | 8.5 | 9.4 | 6.7 | 6.3 |
| 3 | 9.1 | 6.8 | 6.1 | 5.3 |
| 4 | 7.7 | 5.9 | 5.2 | 5.3 |
| 5 | 8.8 | 7.1 | 6.3 | 5.1 |

The rate of ferrite-occurrence is closely related to metal conformability, and should be as low as possible. Conventional spheroidal cast irons have a hardness ranges of HB 270 to 290 when the ferrite-occurrence rate is not more than 10%, with the result that the machinability of the cast iron have been extremely inferior. The spheroidal graphite case iron of the present invention has a stably low ferrite-occurrence rate not more than 10% in spite of the level of its Brinell hardness, which is realized by making the amount of ferrite stabilized to the low level, which low level of ferrite becomes possible by decreasing the diffusion and adsorption of C by use of Sn, Sb and/or As distributed between graphite and matrix.

Machinability tests by use of burnishing were performed on prior art crank shafts and the crank shafts of the present invention under the same machining conditions. The results showed the following favorable effect of the present invention.

TABLE 6

| | Machinability | |
|---|---|---|
| | Number of Test Pieces | Amount of tool wear |
| Comparative sample 1 | 300 | 0.471 mm |
| Comparative sample 2 | 700 | 0.204 mm |
| Sample 1 of the invention | 700 | 0.190 mm |
| Sample 2 of the invention | 700 | 0.086 mm |

In the conventional cases where the amounts of Cu and Mn were controlled, the amount of wear of tools after the machining tests varied considerably, however, in the case of the present invention the amount of wear of tools was smaller than the minimum value in the conventional comparative samples, and it was proved that the machinability of the cast iron was remarkably improved.

As described above, the present invention can bring about many excellent effects as shown below.

1. The rate of ferrite-occurrence around graphite is low, and it is possible to control this rate into a range not more than 10%.
2. It was confirmed that, by decreasing the contents of Cu and Mn, the distribution of Cu and Mn in pearlite was decreased and the hardness of the cast iron became uniform.
3. In a conventional case where the contents of Cu and Mn were controlled to obtain a cast iron, the amount of wear of tools after the machining of the cast iron varied considerably, however, in the present invention the amount of wear of tools was further smaller than the minimum value of the conventional cases, and the machinability of the cast iron was much improved in the invention.
4. The ferrite rings were broken down by use of Sn, Sb and/or As which are concentrated in the interfaces between graphite and matrix and which substantially prevent the diffusion and adsorption of C in graphite and matrix to thereby increase the C content around graphite to a level not less than 0.1% with the result that there occurs such a condition as minimizes the amount of ferrite. Consequently, the machinability was remarkably improved in the present invention.

What is claimed is:

1. Spheroidal graphite cast iron for crank shafts with superior conformability and machinability, consisting, by area ratio, of 5 to 15% graphite, of not more than 10% ferrite, and the balance pearlite matrix, and having a Brinell hardness (HB) of 241 to 277, said cast iron further consisting essentially by weight, of 3 to 4% C; 1.5 to 2.5% Si; less than 0.5% Mn; 0.005 to 0.08% Mg; at least one of 0.010 to 0.050% in total selected from group consisting of Sn, Sb and As; and the balance iron and incidental impurities.

2. Spheroidal graphite case iron for crank shafts as set forth in claim 1, the pearlite matrix having micro Vicker's hardness (HMV) of 250 to 350 at a load of 100 g.

3. Spheroidal graphite cast iron for crank shafts as set forth in claim 1, wherein at least one selected from the group consisting of Sn, Sb and As being concentrated in the interfaces between graphite and pearlite matrix so that ferrite rings are broken down in the cast iron.

4. A crank shaft made of spheroidal graphite cast iron with superior conformability and machinability, said cast iron consisting, by area ratio, of 5 to 15% graphite, of not more than 10% ferrite, and the balance pearlite matrix, said cast iron having a Brinell hardness (HB) of 241 to 277, said cast iron further consisting essentially, by weight, of 3 to 4% C; 1.5 to 2.5% Si; less than 0.5% Mn; 0.005 to 0.08% Mg; at least one of 0.010 to 0.050% in total selected from the group consisting of Sn, Sb and As; and the balance iron and incidental impurities.

5. A crank shaft made of spheroidal graphite cast iron as set forth in claim 4, the pearlite matrix having micro Vicker's hardness (HMV) of 250 to 350 at a load of 100 g.

6. A crank shaft made of spheroidal graphite cast iron as set forth in claim 4, wherein at least one selected from the group consisting of Sn, Sb and As being concentrated in the interfaces between graphite and pearlite matrix so that ferrite are broken down in the cast iron.

* * * * *